United States Patent [19]

Sheppard et al.

[11] Patent Number: 4,799,676

[45] Date of Patent: Jan. 24, 1989

[54] HYDRAULIC EXERCISING MACHINES

[76] Inventors: John H. Sheppard, 4 Edgehill Avenue, Llanishen, Cardiff; Jonathan D. Moore, Timberleigh, West End, Magor, Gwent., both of Great Britain

[21] Appl. No.: 899,960

[22] Filed: Aug. 25, 1986

[30] Foreign Application Priority Data

Aug. 29, 1985 [GB] United Kingdom ..... 8521538

[51] Int. Cl.[4] ..... A63B 21/00

[52] U.S. Cl. ..... 272/130; 60/413

[58] Field of Search ..... 272/116, 129, 130, DIG. 4, 272/134; 60/413, 477, 481

[56] References Cited

U.S. PATENT DOCUMENTS

| | | | |
|---|---|---|---|
| 3,465,592 | 9/1969 | Perrine | 272/130 |
| 4,043,122 | 8/1977 | Graham | 60/477 X |
| 4,063,726 | 12/1977 | Wilson | 272/129 X |
| 4,257,593 | 3/1981 | Keiser | 272/130 |
| 4,341,149 | 7/1982 | Dezelan | 60/413 X |
| 4,406,454 | 9/1983 | Dean | 272/130 X |
| 4,444,390 | 4/1984 | Erickson | 272/130 |
| 4,478,412 | 10/1984 | Muir | 272/130 |

FOREIGN PATENT DOCUMENTS

| | | | |
|---|---|---|---|
| 2124916 | 2/1984 | United Kingdom | 272/129 |

*Primary Examiner*—Richard J. Apley
*Assistant Examiner*—Robert W. Bahr
*Attorney, Agent, or Firm*—Young & Thompson

[57] ABSTRACT

An exercising machine incorporates one or a pair of hydraulic rams to be actuated by a user. The resistance to effort within the hydraulic circuit can be increased by operating a pump so that hydraulic fluid enters a pressure accumulator to compress gas therein. A pressure gauge indicates the pressure level set and the circuits for the two rams can be set individually, selectively bleeding off hydraulic fluid to a reservoir by operation of valves. Consequently the exercising machine can be set to a number of required operating levels without resorting to the use of weights as with conventional exercising machines.

6 Claims, 4 Drawing Sheets

HYDRAULIC EXERCISING MACHINES

BACKGROUND OF THE INVENTION

This invention relates to machines for exercising the human body. Such machines are generally specific to a particular group of muscles and hence for overall conditioning a number of different machines are required. Conventionally such machines incorporate a support on which weights are mounted to a value determined by the user and as his ability to use the machine increases naturally he will increase the amount of weight carried so as to achieve further improvement. The weights are interchangeable between the machines and if the machines are being used by a number of persons in a gymnasium difficulties can arise when two persons require to use some of the weights at the same time. The operator of the gymnasium therefore needs to provide a substantial number of weights of varying values to try and meet normal demand. The individual weights are relatively expensive and of curse considerations have to be made as to the load bearing capacity of the floor of the gymnasium.

It is an object of this invention to provide an exercising machine which avoids the need to share part of the operating equipment with other similar machines.

SUMMARY OF THE INVENTION

Accordingly this invention provides an exercising machine comprising a fixed frame and a movable member which can be moved related to the frame against the bias of a hydraulic or pneumatic ram, the hydraulic or pneumatic circuit for the ram including a pump for setting a predetermined pressure, a gauge for registering the applied pressure, and a pressure accumulator.

Such machines do not incorporate the conventional weights and instead the user of the machine can set the required loading by operating the pump until the gauge registers a figure related to an equivalent dead weight which he would hope to raise on a conventional exercising machine. Overall this machine is of generally less heavy construction than one which requires the provision of a substantial number of weights which have to be loaded on to a support on the machine and of course the equipment is entirely self-contained and does not need to share any of its parts with any other exercising machine. A further advantage which is achieved by the exercising machine of this invention is that as the user applies an effort to operate the hydraulic or pneumatic ram against the bias, the pressure will in fact increase so that the effort he has to apply increases which counteracts, at least to some extent, the fact that with most exercising machines the actuating movement by the user becomes easier towards the end of the exercise because the user's muscles are in a better position to operate them.

In the preferred arrangement the pressure accumulator is a compressed nitrogen or other convenient gas accumulator. The size and operating effect of the accumulator will determine the extent to which the resistance to motion increases as the exercise is carried out.

In some types of machine it will be of advantage to include two movable members which can be moved with respect to the frame independently of one another and which act against the bias of separate rams having respective associated hydraulic or pneumatic circuits. Such an arrangement would, for example, be useful for exercises where the two arms of the user are pressing against or pulling against independent resistive forces. The two circuits for such a modified machine may be supplied from a common pump. In such a case the two circuits would ideally incorporate valves enabling the pressure levels in the two circuits to be set independently of one another.

The movable members will normally be mounted slidably or pivotably on the frame. The frame may also incorporate support structure for supporting parts of the body of the user of the machine.

BRIEF DESCRIPTION OF THE FIGURES

The invention may be performed in various ways and preferred embodiments thereof will now be described with reference to the accompanying drawings, in which.

DETAILED DESCRIPTION

Figure 1:
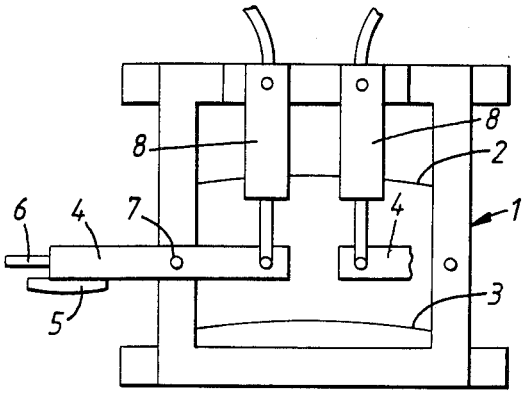
FIGS. 1 and 2 comprise overhead plan and front views of an exercising machine of this invention for strengthening pectoral muscles.
Figure 2:
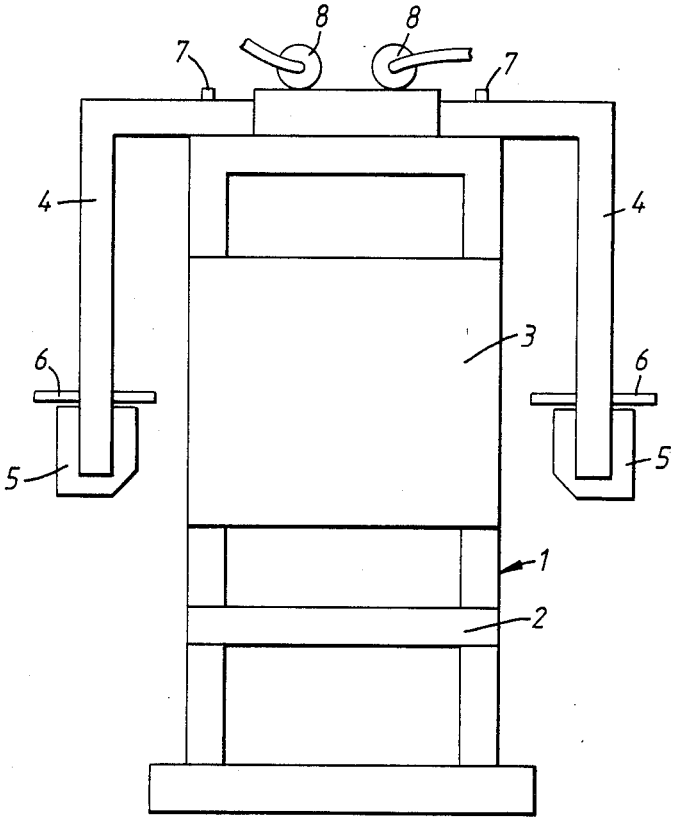

Referring firstly to FIGS. 1 and 2, there is shown a rigid framework 1 incorporating a padded seat 2 and a padded backrest 3. The user of the machine will sit on the seat and push against a pair of arms 4 either directly on to pads 5 or additionally by grasping handles 6. The arms of the user, as they travel in an arc towards the centre of the body will rotate the arms 4 about pivots 7 incorporating suitable bearings so that the pistons are withdrawn from pull-type hydraulic piston and cylinder units 8.

Figure 3:
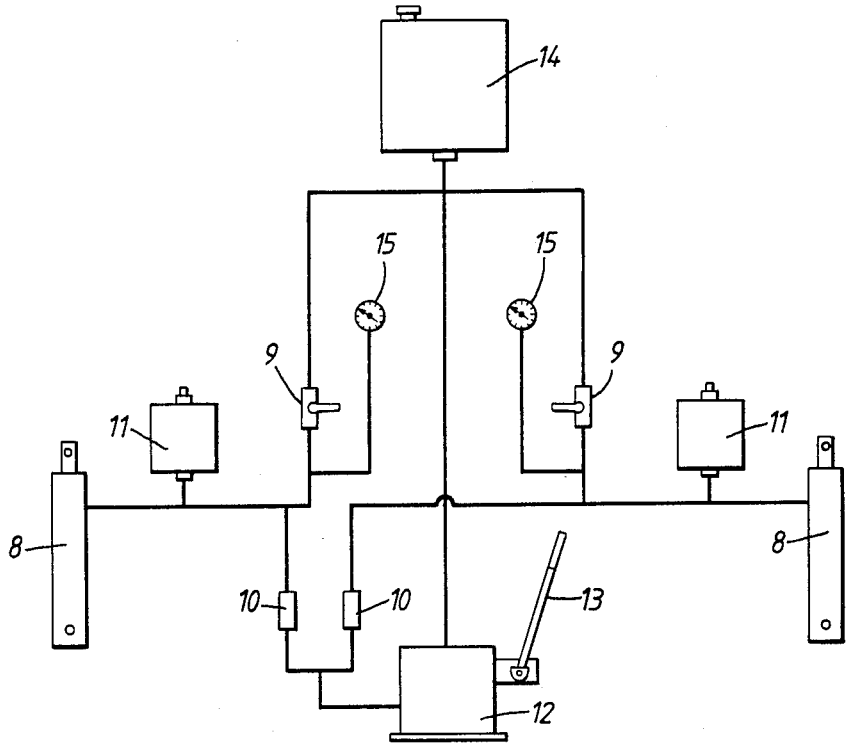
FIG. 3 is a diagrammatic illustration of a circuit controlling the machine of FIGS. 1 and 2.

The hydraulic circuits associated with the unit 8 create resistance to the effort applied by the user and this is illustrated in FIG. 3. Taking, for example, the left-hand unit 8 in FIG. 3 and with valves 9 and 10 in a closed condition, hydraulic fluid within the associated circuit acts to compress nitrogen gas within an accumulator 11. Hence as the arms 4 are moved further and further through the arc towards the centre of the user's body the effort required increases. This counteracts the fact that the user's pectoral muscles are more readily brought into play as the user's arms approach the straight-ahead condition from the spread-eagled arm position. This therefore creates a greatly enhanced exercising effect for the pectoral muscles as compared, for example, with a conventional exercising device which relies upon the lifting of fixed weights. The initial effort required to operate the device may be modified as desired by operating a hydraulic pump 12 provided with a handle 13. This feeds hydraulic fluid from a reservoir 14 through non-return valves 10 to circuits incorporating the respective units 8 and accumulators 11. During this priming of the system of course the two-position valves 9 will be in the closed condition. The initial preset resistance in the circuits will be shown on gauges 15. When a desired level is reached the machine is ready for use. As the machine is operated by the user the increase in the resistive force applied to the accumulators 11 will be registered on the gauges 15. When the applied forces achieved by the user are not sustained the stored force will react upon the user's arms in a reverse manner due to the action of the compressed nitrogen gas in the accumulators 11 on the stored volume of hydraulic fluid within the system.

The machine can be set to provide a different preset resistance to movement for each of the user's arms in the following manner. Firstly the hydraulic pump 12 is operated until the required maximum initial resistance is registered on the gauges 15. The relevant valve 9 will then be opened slightly until a required lower resistance reading registers on the appropriate gauge 15 whereupon the valve 9 will then be closed fully. This allows the user to exercise the pectoral muscles associated with his two arms to different extents in the same exercise and would be useful, for example, where a muscle injury has been sustained to one side of the body or where it is desired to increase the strength of one set of pectoral muscles up to an existing level for the other side. It will be appreciated that the machine could be used for exercising the pectoral muscles on one side of the body only by bleeding off oil back to the reservoir 14 on just one side of the system by opening the relevant valve 9 fully. It might be necessary initially to pump the whole system up to a pressure greater than that ultimately required and then decrease the reading to the desired resistance figure as shown on the gauge 15 associated with the operating side of the system once the oil has been bled from the other side of the system.

Figure 4:
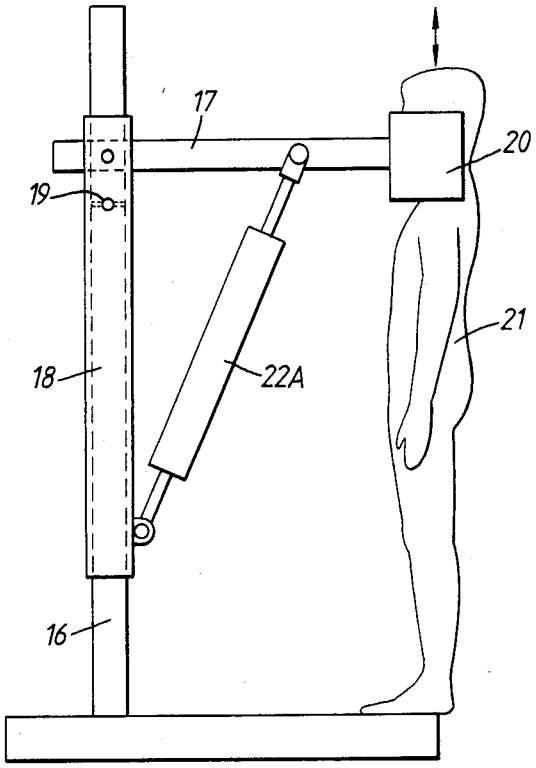
FIGS. 4, 5 and 6 are side views of further exercising machines of this invention for strengthening leg and arm muscles.
Figure 5:
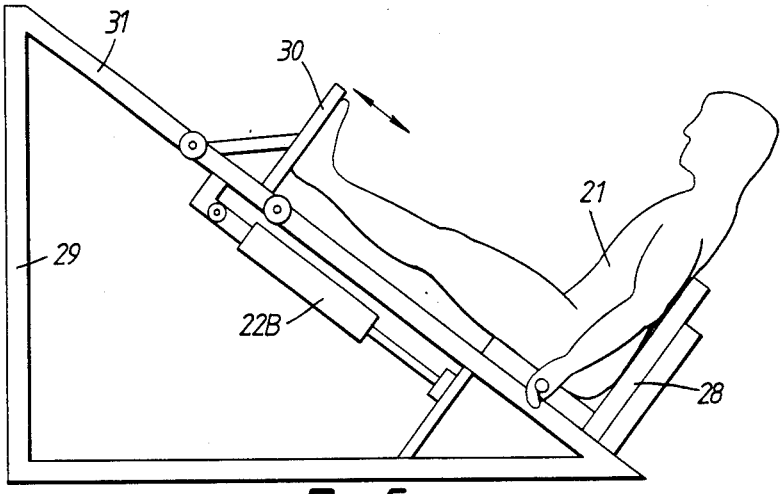
Figure 6:
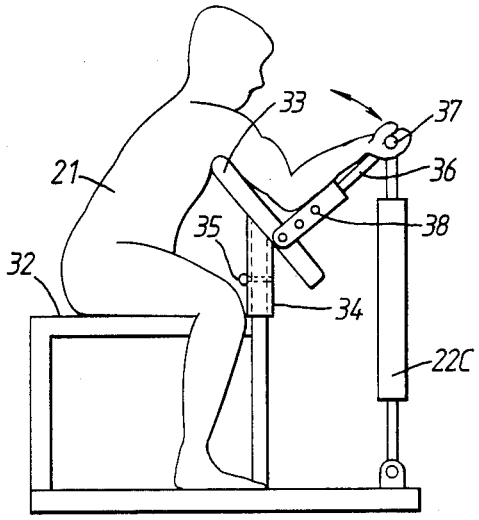

Further exercising devices are illustrated in FIGS. 4 to 6. The calf exercising machine of FIG. 4 incorporates a framework 16 on which is pivotally mounted an arm 17 carried by a sleeve 18 which can be adjusted for height with respect to the frame 16 by moving a fixing pin 19 into a required hole passing through the upright of the frame 16. A pad 20 at the end of the arm 17 will rest on the shoulder of the user 21 (with the sleeve 18 adjusted to the required height). The user will then raise his body on to his toes against a resistance created by a pull-type hydraulic piston and cylinder unit 22 which is equivalent to the unit 8 and will be incorporated into the circuit illustrated in FIG. 7. This is in many ways equivalent to the circuit of FIG. 3 but with modifications suitable for use with a single piston and cylinder unit. Thus these two circuits employ a piston and cylinder unit (8 or 22A), an hydraulic pump (12 or 23), a valve (10 or 24), an accumulator (11 or 27) and a gauge (15 or 26). Sequential raising and lowering of the body in this manner will exercise the calf muscles. The unit 22A is interconnected with a hydraulic hand-operated pump 23 through a bypass valve 24 in a circuit 25. A pressure gauge 26 and a nitrogen gas hydraulic accumulator 27 are also connected into the circuit 25. Again, therefore, the resistance to the effort applied by the user can be set to a desired level, as registered on the gauge 26, by operating the pump 23. Furthermore there will be a progressive resistance to the raising movement on the arm 17 created by the user due to the increase in pressure throughout the system as the hydraulic fluid acts upon the compressed nitrogen gas in the accumulator 27.

Figure 7:
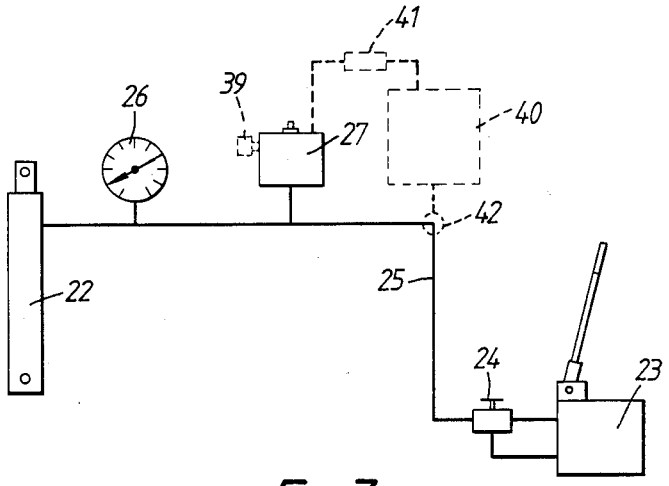
FIG. 7 illustrates features of a circuit for controlling any of the devices shown in FIGS. 4 to 6.

A machine for strengthening the thigh muscles is illustrated in FIG. 5. Here the user 21 sits on a tilted seat 28 attached to a frame 29 with his feet resting on a platform 30. This platform is mounted for sliding movement up the sloping part 31 of the frame and is attached to a hydraulic unit 22B. This unit is also incorporated within a hydraulic circuit of the type as shown in FIG. 7 of the drawings so that the initial resistance to effort by the user can be set and a progressive resistance to movement will be experienced as the user's legs approach the fully extended position.

Finally, FIG. 6 illustrates a device for strengthening bicep muscles. The user 21 sits on a seat 32 and rests his upper arms over a tilted support 33. This support can be positioned at a desired height with respect to the seat 32 by raising or lowering a sleeve 34 to which the support 33 is attached and fixing it in a required position by a pin 35 passing through a suitable hole in the seat upright. A pivot lever 36 is attached to either end of the support 33 and the two levers are linked at their other ends by a bar 37. The lengths of the levers 36 can-be adjusted by the adjusting means illustrated at 38 to enable the user to regulate the lengths of the levers 36 to the length of his forearm. As the user moves his forearms about the elbows while gripping the bar 37 this will cause operation of a hydraulic unit 22C. This unit 22C is connected into a circuit of the form as illustrated in FIG. 7 enabling a preset resistance to movement to be set on the gauge 26. Again the resistance to effort applied by the user will increase as he raises his forearm further due to the increase in pressure created in the accumulator 27.

A problem can arise if the range of effort to be applied to the hydraulic piston and cylinder unit 22 (or 8) is likely to be wide (for example, to suit operators of varying strengths). If the pump 23 is operated to record a high pressure on the gauge 26, then the volume occupied by the compressed nitrogen gas will be quite small so that the progressive resistance to operation of the unit 22 will increase quite markedly over the range of operation of the equipment, which would make it difficult for the user to apply the final operating effort. This could be countered by providing a much bigger accumulator 27 but then if the equipment is used over lower pressure ranges the progressive resistance to operation from the start to the finish of an actuation of the unit 22 will not vary very much. This problem could be resolved in one of two ways. Firstly, the accumulator 27 could be provided with a valved inlet 39 to which a bottle of compressed nitrogen could be applied to enable the quantity of nitrogen within the volume of the accumulator 27 to be increased. This, however, is not very satisfactory since it leads to a requirement for storing bottles of compressed nitrogen and, when the quantity of nitrogen within the accumulator 27 is to be decreased (by bleeding off through the valve 39), the nitrogen gas will of course be lost. A preferred alternative is to incorporate the additional parts shown in dashed outline in FIG. 7. This comprises a further accumulator 40 connected from the supply line 25 from the pump 23 and interconnected with the accumulator 27 via a valve 41. A two-way valve 42 enables the supply line 25 to be connected either to the accumulator 40 or to the accumulator 27. This modified apparatus can be operated as follows. With the supply line 25 connected to the accumulator 40 and the valve 41 in the open condition, the nitrogen gas within the combined system of the two accumulators can be compressed to a desired level, whereupon the valve 41 will be closed. Hence the quantity of gas within the accumulator 27 will be as required for a particular operation and when it is desired to reduce the pressure within the accumulator 27, the valve 41 can be opened to bleed the gas back into the accumulator 40. If it is desired to pressurize only the accumulator 27, the valve 42 can be moved to the other position. In a more simple version the valve 42 could be omitted and the supply line 25 would be connected only to the accumulator 40.

It will be appreciated that the modifications made to the accumulator 27 (including the addition of the extra accumulator 40 and valves 41 and 42) could be made equally to the accumulators 11 illustrated in FIG. 3.

The principle of operation utilizing hydraulic rams connected in circuit with an accumulator may be applied to other types of physical exercising machine than those illustrated in the drawings. Thus a comprehensive series of exercises may be carried out by several people at a time, each on his own exercising machine and there is no need for the users to share weights as is often necessary in conventional exercising equipment. Furthermore, the user can quickly set up a machine to offer a particular resistance level which is immediately indicated on the gauge. It is a simple matter therefore for the user to keep a precise record of his progress and to increase the effect of the exercise with time. It is envisaged that an output line,could be teed in to the hydraulic circuit to control a computerized recording device which could be used, for example, to store records of the user's performance.

We claim:

1. An exercising machine, comprising (a) a frame;

(b) an exercise member connected with said frame for movement relative thereto;

(c) a hydraulic piston and cylinder unit connected between said frame and said member for providing a biasing force resisting movement of said member relative to said frame; and (d) hydraulic control means for controlling the biasing force of said piston and cylinder unit, said hydraulic control means including (1) a pump for pumping hydraulic fluid to said piston and cylinder unit;

(2) a hydraulic line connecting said pump with said piston and cylinder unit, whereby said pump is operable to establish a predetermined starting pressure within said piston and cylinder unit;

(3) a pressure gauge connected with said hydraulic line for registering the hydraulic pressure therein; and (4) pressure accumulator means incorporating a compressed gas and connected with said hydraulic line for pressurization by said hydraulic fluid, said accumulator means comprising (i) first and second accumulator units hydraulically connected in series, each of said units being connected with said hydraulic line;

(ii) an on/off valve arranged in the series connection between said units separate from said hydraulic line; and (iii) a two-way valve link arranged in said hydraulic line between said pump and the line connections of said first and second accumulator units, said two-way valve link being selectively movable between a first position connecting said pump solely with said line connection to said first accumulator unit, and a second position connecting said pump solely with said line connection to said second accumulator unit, whereby the volume of said accumulator means communicating with said hydraulic lines may be selected in accordance with the selected positions of said on/off valve and said two-way valve link.

2. An exercising machine according to claim 1 wherein said two accumulator units have different volumes.

3. An exercising machine according to claim 1, including two movable members which can be moved with respect to the frame independently of one another and which act against the bias of separate hydraulic piston and cylinder units having similar respective associated hydraulic control means.

4. An exercising machine according to claim 3, wherein a common pump supplies the two circuits.

5. An exercising machine according to claim 4, wherein valves are incorporated in the two circuits to enable the pressure levels in each circuit to be set independently of the other.

6. An exercising machine according to claim 1, wherein the frame incorporates support structure for supporting parts of the body of the user of the machine.

* * * * *